US005372922A

United States Patent [19]

Schofield et al.

[11] Patent Number: 5,372,922

[45] Date of Patent: Dec. 13, 1994

[54] METHOD OF PREPARING PHOTOGRAPHIC ELEMENTS INCORPORATING POLYMERIC ULTRAV33ET10BSORBERS LOADED WITH HIGH BOILING POINT ORGANIC SOLVENTS

[75] Inventors: Edward Schofield; Tienteh Chen, both of Penfield, N.Y.

[73] Assignee: Eastman Kodak Company, Rochester, N.Y.

[21] Appl. No.: 175,081

[22] Filed: Dec. 29, 1993

[51] Int. Cl.[5] ..... G03C 1/815

[52] U.S. Cl. ..... 430/572; 430/270; 430/510; 430/931

[58] Field of Search ..... 430/512, 270, 510, 523, 430/931

[56] References Cited

U.S. PATENT DOCUMENTS

| | | | |
|---|---|---|---|
| 3,745,010 | 7/1973 | Janssens et al. | 96/84 |
| 3,761,272 | 9/1973 | Mannens et al. | 96/84 |
| 4,340,664 | 7/1982 | Monbaliu et al. | 430/449 |
| 4,431,726 | 2/1984 | Kojima et al. | 430/512 |
| 4,443,534 | 4/1984 | Kojima et al. | 430/512 |
| 4,455,368 | 6/1984 | Kojima et al. | 430/507 |
| 4,464,462 | 8/1984 | Sugimoto et al. | 430/512 |
| 4,464,463 | 8/1984 | Kojima et al. | 430/512 |
| 4,496,650 | 1/1985 | Yagihara et al. | 430/381 |
| 4,551,420 | 11/1985 | Sugimoto et al. | 430/505 |
| 4,622,287 | 11/1986 | Umemoto et al. | 430/505 |
| 4,645,735 | 2/1987 | Sugimoto et al. | 430/512 |
| 4,748,100 | 5/1988 | Umemoto et al. | 430/505 |
| 4,748,107 | 5/1988 | Umemoto et al. | 430/505 |
| 4,790,959 | 12/1988 | Sasaki et al. | 252/589 |
| 4,840,878 | 6/1989 | Hirose et al. | 430/380 |
| 4,865,963 | 9/1989 | Furutachi et al. | 430/558 |
| 4,873,182 | 10/1989 | Delprato | 430/546 |
| 4,943,519 | 7/1990 | Helling et al. | 430/512 |
| 5,084,375 | 1/1992 | Umemoto et al. | 430/505 |
| 5,112,729 | 5/1992 | Mihayashi | 430/546 |

FOREIGN PATENT DOCUMENTS

| | | |
|---|---|---|
| 0271005 | 6/1988 | European Pat. Off. . |
| 291168 | 10/1983 | Germany . |
| 8185-677 | 4/1982 | Japan . |
| 140344 | 7/1984 | Japan . |
| 2080-641 | 10/1985 | Japan . |
| 2080-642 | 10/1985 | Japan . |
| 31430541 | 12/1986 | Japan . |
| 4003-053 | 4/1990 | Japan . |

*Primary Examiner*—Jack P. Brammer
*Attorney, Agent, or Firm*—Gordon M. Stewart

[57] ABSTRACT

A method of preparing a photographic element containing a UV filter composition. In the method a UV absorbing polymer latex is prepared by emulsion polymerization, then loaded with a high boiling point organic solvent. The high boiling poing organic solvent has a boiling point at atmospheric pressure of at least 200° C. The loaded polymer latex is then incorporated into a photographic element. Photographic elements containing UV polymer latexes particularly of a UV absorbing polymer containing benzotriazole monomers loaded with high boiling point organic solvents, are also provided.

11 Claims, No Drawings

METHOD OF PREPARING PHOTOGRAPHIC ELEMENTS INCORPORATING POLYMERIC ULTRAV33ET10BSORBERS LOADED WITH HIGH BOILING POINT ORGANIC SOLVENTS

FIELD OF THE INVENTION

This invention relates to a method of preparing photographic elements which incorporate a latex of a polymeric ultraviolet absorber which is loaded with a high boiling point organic solvent, and the resultant photographic elements.

BACKGROUND OF THE INVENTION

Typical photographic elements use silver halide emulsions, the silver halide having a native sensitivity to ultraviolet UV radiation ("UV"). Such UV sensitivity is usually undesirable in that it produces an image on the photographic element which is not visible to the human eye. In addition, in the case of color photographic elements, in particular, color dye images formed on the light sensitive emulsion layers by color development easily undergo fading or discoloration due to the action of UV. Also, color formers, or so-called couplers, remaining in the emulsion layers are subject to the action of UV to form undesirable color stains on the finished photographs. The fading and the discoloration of the color images are easily caused by UV of wavelengths near the visible region, namely, those of wavelengths from 300 to 400 nm. For the foregoing reasons, photographic elements typically incorporate a UV absorbing material in an upper layer.

By reference to "under", "above", "below", "upper", "lower" or the like terms in relation to layer structure of a photographic element, is meant the relative position in relation to light to when the element is exposed in a normal manner. "Above" or "upper" would mean closer to the light source when the element is exposed normally, while "below" or "lower" would mean further from the light source. Since a typical photographic element has the various layers coated on a support, "above" or "upper" would mean further from the support, while "below" or "under" would mean closer to the support.

Many types of UV absorbing materials have been described previously, and include those described in U.S. Pat. Nos. 3,215,530, 3,707,375, 3,705,805, 3,352,681, 3,278,448, 3,253,921, and 3,738,837, 4,045,229, 4,790,959. 4,853,471, 4,865,957, and 4,752,298, and United Kingdom Patent 1,338,265. Known UV absorbing materials often have many undesirable characteristics. For example, they tend to color and form stains due to their insufficient stability to UV, heat, and humidity. Also, a high-boiling organic solvent is usually required for the emulsification of the UV absorbing agents, which softens the layer and substantially deteriorates interlayer adhesion. In order to prevent these problems, a large amount of gelatin has been used in the layer containing the UV absorbent, resulting in a layer which may be unstable. Alternatively, a separate gelatin protective layer was provided over the UV absorbent containing layer. Such approach results in an undesirable thickening of the element. Furthermore, previously known UV absorbing agents, when provided in the uppermost layer of a photographic element, often migrate and crystallize at the surface of the layer. Thus, a gel overcoat would be used to minimize this undesirable blooming phenomenon. Furthermore, the droplets of such UV absorbing materials, when prepared by the conventional emulsification method described above, usually have particle sizes greater than 200 nm thereby producing light scattering with resulting deterioration of the element's photographic properties. The toxicity of such UV absorbing agents has also become an important issue recently.

It is known that polymer latexes obtained by polymerization of UV absorbing monomers, can be utilized as UV absorbing agents which do not have many of the disadvantages described above. At least three methods of adding polymeric UV absorbing agents in the form of latex to hydrophilic colloid composition, are known. The first method comprises adding a latex prepared by emulsion polymerization directly to a gelatin-containing silver halide emulsion. Emulsion polymerization is well known in the art and is described in F. A. Bovey, *Emulsion Polymerization* issued by Interscience Publishers Inc. New York, 1955. This is the most direct way of preparing a polymer latex.

A second method of forming a polymer latex is by solution polymerization of a monomeric mixture of UV absorbing monomer, a comonomer, and an ionic comonomer containing sulfonic, sulfuric, sulfinic, carboxylic or phosphoric acid, and their metal salts, such as acrylamido -2,2'-dimethyl-propane sulfonic acid, 2-sulfoethyl methacrylate, or sodium styrene sulfonate. The polymer solution obtained is then dispersed in aqueous solution and forms a latex.

The third method of forming a polymer latex is by solution polymerization of monomer mixture comprising UV absorbing monomer and hydrophobic comonomers. The polymeric UV absorber is isolated and dissolved in an auxiliary solvent, such as ethyl acetate, with a permanent solvent optionally also being present. This solution is mixed with an aqueous gelatin solution and the mixture passed through a high-shear device, such as a colloid mill, to form a latex.

Polymeric UV absorbing polymer latexes prepared by the foregoing type processes have been described in, for example, U.S. Pat. Nos. 3,761,272; 3,745,010; 4,307,184; 4,455,368; 4,464,462; 4,513,080; 4,340,664; GB 1,504,949; GB 1,504,950; British Patent 1,346,764; EP Application 0 190 003 and others. Some polymer-latexes containing polymers of certain specific structures, have been previously used in photographic elements. For example, U.S. Pat. No. 4,551,420 and U.S. Pat. No. 4,464,462 describe photographic elements with polymer latexes. U.S. Pat. No. 4,943,519 describes the use of latexes formed from various ultraviolet absorbing polymers in photographic film, the patent indicating that the latexes can be formed by emulsion or solution polymerization.

Among the three methods described above, emulsion polymerization is most desirable method of forming a polymer latex because no washing is required to remove solvents since no auxiliary solvent is used. Importantly, the size of the particles formed by emulsion polymerization is smaller than that produced by the other two methods. Smaller particles in the latex reduce light scattering in the photographic materials and improves dye density and gloss.

However, although UV absorbing polymer latexes prepared by emulsion polymerization have the advantages as described above, one of the disadvantages is that UV absorbing latexes prepared by emulsion polymerization exhibit poor light stability.

It would be desirable to provide a method of preparing photographic elements containing a absorbing polymer latex which is prepared by emulsion polymerization, but which nevertheless has good light stability. It would also be desirable to provide a photographic element containing a polymeric UV absorber composition, particularly one prepared by emulsion polymerization, such that the composition itself is relatively stable to light in the typical photographic element environment.

SUMMARY OF THE INVENTION

It has been found that polymer latexes exhibit enhanced light stability when loaded with an organic solvent having a boiling point of at least 200° C. The present invention therefore first provides a method of preparing a UV filter composition for a photographic element which method comprises preparing a UV absorbing polymer latex by emulsion polymerization. The resulting polymer latex is then loaded with a water immiscible organic solvent having a boiling point of at least 200° C. (all boiling points throughout this application are at 1 atmosphere pressure unless otherwise indicated) and incorporating the loaded polymer latex into a photographic element. By "water immiscible" is meant a solubility in water of less than 1% by weight at 25° C. By "loaded" or "loading" or similar terms, is meant that the latex particles contain, or are provided with, the high boiling organic solvent.

EMBODIMENTS OF THE INVENTION

In reference to "polymers" of the UV absorbing monomer, this means that the compound would contain at least 10 (and preferably at least 20 and more preferably at least 50) repeating units of the specified UV absorbing monomer. Typically the polymers would have hundreds (for example, three hundred or more) or several thousand (for example, three thousand or more) repeating units. The terms "upper", "under" and the like, have already been described above. For a compound to be considered a UV absorbing one in the present invention, it should at least absorb somewhere in the 300 to 400 nm region of the spectrum. When reference herein is made to a substituent "group", this means that the substituent may itself be substituted or unsubstituted (for example "alkyl group" refers to a substituted or unsubstituted alkyl). Any such groups may broadly be linear or branched where possible.

Preferably the polymer (which may be a homopolymer or heteropolymer) of the polymer latex is obtained by emulsion polymerization of monomers which include monomers of the formula:

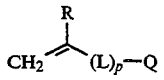

(I)

wherein:

R represents a hydrogen atom or an alkyl group (particularly and alkyl of 1 to 6 or 1 to 4 carbon atoms);

L represents a bivalent linking group;

p is 0 or 1; and

Q is of the formula:

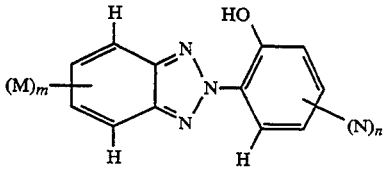

(II)

wherein:

m is 0 to 2;

n is 0 to 3, provided n or m is at least 1, and the phenyl and benzo rings may be optionally further substituted except at the positions at which —H is shown (that is, except at the shown ortho position on the phenyl ring and the two benzo ring carbons attached to the triazole ring);

M and N represent locations at which Q is bonded to the remainder of the monomer of formula I (that is, bonded to L when p is 1 or bonded directly to the ethylene when p=0).

Of the various types of UV absorbing polymers of formula I above, it is preferred that the polymer has the formula:

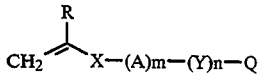

(IA)

wherein R represents a hydrogen atom, a lower alkyl group having from 1 to 4 carbon atoms(for example, a methyl group, an ethyl group, an n-propyl group, an isopropyl group or an n-butyl group, etc.) or a chlorine atom; X represents —CONH—, —COO— or a phenylene group; A represents a linking group selected from an alkylene group having from 1 to 20 carbon atoms(for example, a methylene group, an ethylene group, a trimethylene group, a pentamethylene, a 2-hydroxytrimethylene group, etc.), or an arylene group having from 6 to 20 carbon atoms(for example, a phenylene group, etc.); Y represents —COO—, —OCO—, —CONH—, —NHCO—, —NHCONH—, —OCONH—, —$SO_2$NH—, —NH$SO_2$—, —$SO_2$—, or —O—; m represents 0 or an integer of 1; n represents 0 or an integer of 1; and Q represents an absorbing group represented by the following general formula:

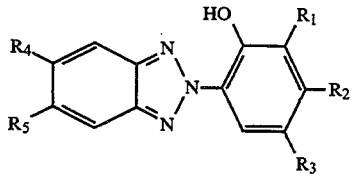

(IIA)

wherein $R_1$, $R_2$, $R_3$, $R_4$, and $R_5$, which may be the same or different, each represents a hydrogen atom, a halogen atom (for example, a chlorine or bromine atom), an alkyl group having from 1 to 20 carbon atoms (for example, a methyl group, an ethyl group, an n-propyl group, an isopropyl group, a butyl group, a tert-butyl group, an n-amyl group, an n-octyl group, a tert-octyl group, a methoxyethyl group, an ethoxyethyl group, a hydroxyethyl group, a benzyl or a cyanoethyl group), an aryl group having from 6 to 20 atom carbon atoms (for example, a phenyl group, a tolyl group, a mesityl group, or the like), an alkoxy group having from 1 to 20 carbon atoms (for example, a methoxy group, an ethoxy group, a propoxy group, a butoxy group, an ethoxyethoxy group, or the like), an aryloxy group having from 6 to 20 carbon atoms (for example, a phenoxy group, or a 4-methypheoxy group, or the like), an alkylthio group having from 6 to 20 carbon atoms (for example, a phenylthio group, or the like), an amino group, an aminoalkyl group having from 1 to 20 carbon atoms (for example, a methylamino group, an ethylamino group, etc.), an arylamino group having from 6 to 20 carbon atoms (for example, an anilino group), a hydroxy group, a cyano group, a nitro group, an acylamino group (for example, an acetylamino group, etc.), a carbomoyl group, a sulfonyl group, a sulfamoyl group, a sulfonamido group, an acyloxy group (for example, an acetoxy group or a benzoyloxy group, etc.) or an oxycarbonyl group (for example, a methoxycarbonyl group, etc.). Further, at least one of $R_1$,$R_2$,$R_3$,$R_4$, and $R_5$ bonds to the vinyl group through the above- described linking group. However, at least one of R1,R2,R3,R4, and $R_5$ is a divalent group which bonds to the remainder of the monomer of formula I (that is, at least one of those groups will also be bonded to Y, A or X in formula I depending on the values of m and n).

Two particularly preferred structures of the ultraviolet light absorbing polymer of formula I are shown in formulae IIIA and IIIB below:

IIIA

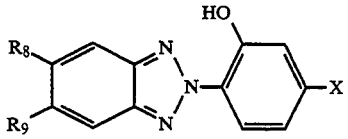

IIIB

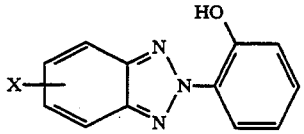

wherein:

X is one of the following groups:

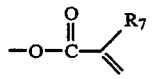

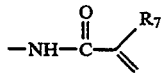

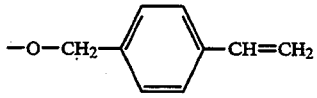

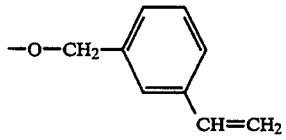

$R_7$ is 1 to 4 carbon atom alkyl group and all of the rings have no further substituents than those shown.

The polymer may be a homopolymer or copolymer. Copolymers may include any other monomers of formula I or other monomers compatable with the polymer and the photographic environment. Furthermore, two or more of the UV absorbing polymers can be present in the polymer latex together, or with other UV absorbing polymeric agents described in the prior art. The copolymers may particularly include repeating units derived from acrylate, alkylacrylate, acrylamide, alykylacrylamide or vinyl aromatic monomers having a formula other than I. Particularly, a copolymer may contain units of the formula:

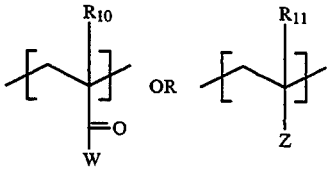

wherein

W is substituted or unsubstituted amino, substituted or unsubstituted alkoxy, substituted or unsubstituted phenoxy; Z is a substituted or unsubstituted phenyl; and $R_{10}$ and $R_{11}$ are H or a substituted or unsubstituted 1 to 6 carbon atom alkyl.

The substituents on the above described groups for $R_1$ through $R_{11}$, and W and Z, the phenyl ring and benzo ring, as well as for any other possibly "substituted" group described, can include any known substituents, such as halogen (for example, chloro, fluoro, bromo, iodo), alkoxy (for example, methoxy, ethoxy), substituted or unsubstituted alkyl (for example, methyl, trifiuoromethyl), alkenyl, thioalkyl (for example, methylthio or ethylthio), substituted and unsubstituted aryl (for example, phenyl) heterocyclic structures (for example, thienyl, furyl, pyrrolyl), alkoxy and others known in the art. Such alkyl and alkoxy substituents may specifically include "lower" alkyl and alkoxy, that is having from 1 to 6 carbon atoms, for example, methyl, ethyl, and the like. Additionally, substituents may form bridged linkages. Further, with regard to any alkyl group, alkylene group or alkenyl group, it will be understood that these can be branched or unbranched and include ring structures.

Examples of monomers which can be polymerized at the unsaturated ethylene group (to produce homopolymers or heteropolymers as described herein), include M-1 to M-10 below. Monomers of such types can be prepared by methods such as described in EP 0 190 003 B1, U.S. Pat. No. 4,496,650, and U.S. Pat. No. 4,716,234, which are incorporated herein by reference.

M-1

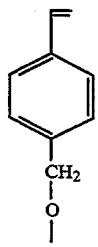

-continued
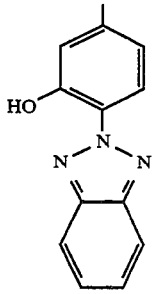
M-2
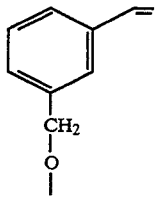
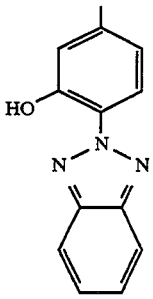
M-3
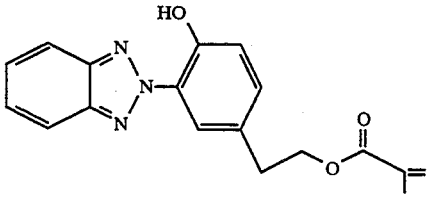
M-4
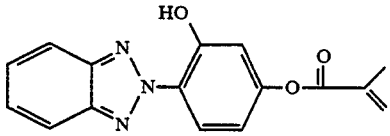
M-5
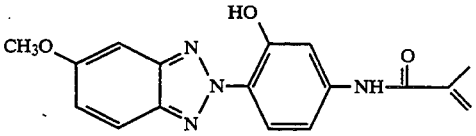
M-6
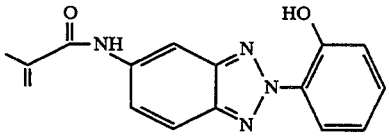
M-7
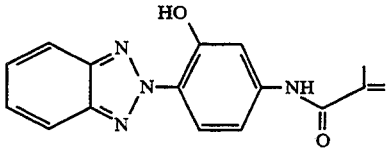
-continued
M-8
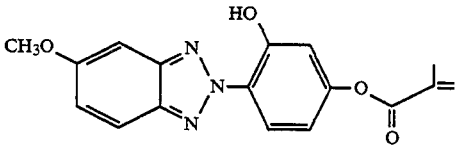
M-9
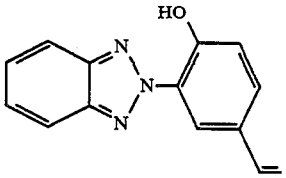
M-10
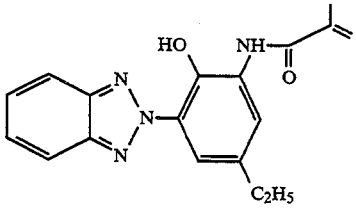
M-11
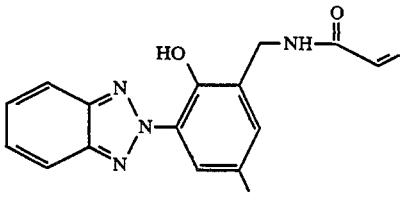
M-12
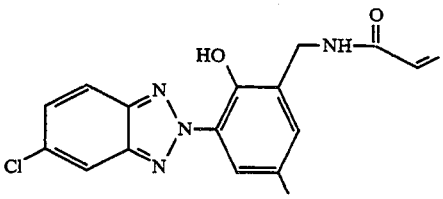
M-13
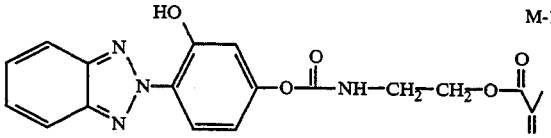
M-14
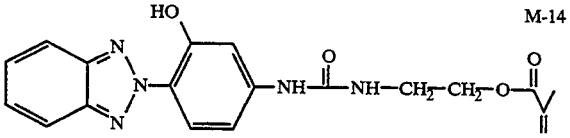
M-15
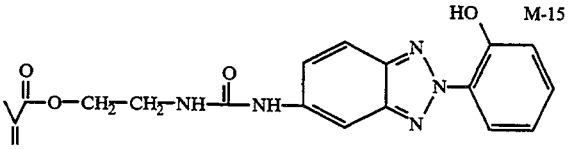
M-16
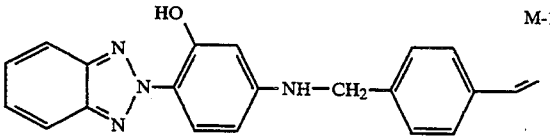

-continued

M-17

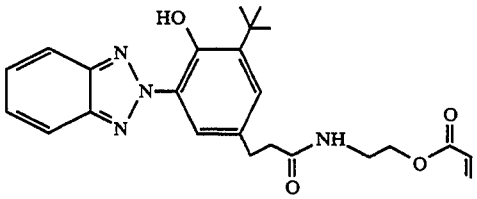

M-18

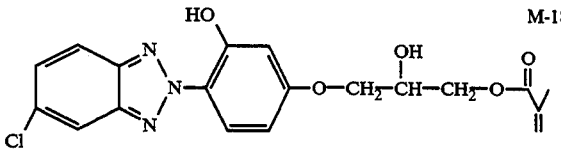

As already mentioned, any ethylenically unsaturated comonomer or comonomers can be copolymerized with any of the previously described monomeric units. Such comonomers can include an acrylic acid, an α-alkylacrylacid (such as methacrylic acid, etc.), an ester or amide derived from an acrylic acid or methacrylic acid (for example, acrylamide, methacrylamide, n-butylacrylamide, t-butylacrylamide, diacetone acrylamide, methyl acrylate, ethyl acrylate, n-propylacrylate, n-butyl acrylate, t-butyl acrylate, isobutyl acrylate, 2-ethylhexyl acrylate, n-octyl acrylate, lauryl acrylate, 2-ethoxyethyl acrylate, 2-methoxyethyl acrylate, methyl methacrylate, ethyl methacrylate, n-butyl methacrylate, b-hydroxyl methacrylate, etc.), a vinyl ester(-for example, vinyl acetate, vinyl propionate, vinyl laurate, etc.), acrylonitrile, methacrylonitrile, an aromatic vinyl compound (for example, styrene and a derivative thereof, for example, vinyl toluene, divinylbenzene, vinyl acetophenone, sulfostyrene, etc.), iraconic acid, citraconic acid, crotonic acid, vinylidene chloride, a vinyl alkyl ether(for example, vinyl ethyl ether, etc.), an ester of maleic acid, N-vinyl-2-pyrrolidone, N-vinylpyridine, 2- or 4-vinylpyridine, etc., an sulfonic acid containing monomers, (for example, acrylamido-2,2'-dimethyl-propane sulfonic acid, 2-sulfoethyl methacrylate, 3-sulfopropyl methacrylate, and the like).

Of these monomers, esters of acrylic acid, esters of methacrylic acid, and aromatic vinyl compounds are preferred.

Two or more of the UV absorbing monomers can be copolymerized together. For example, M-1 and M-3 can be copolymerized together or either or both with other UV absorbing monomers described in the prior art. One, two or more of the UV absorbing monomers can be copolymerized with one, two or more of the above described comonomers. For example, a combination of butyl acrylate and acrylamido-2,2'- dimethyl propane sulfonic acid can be present in a polymer containing units of formula I. Of the foregoing comonomers, an ester of acrylic acid, an ester of methacrylic acid, and an aromatic vinyl compounds are particularly preferred.

It is preferred that the photographic elements of the present invention have UV absorbing polymers in which the molar ratio of the amount of repeating units formed from a comonomer to the amount of repeating units of formula I, be from 0 to 10, and a molar ratio of from 0 to 5 is particularly preferred. The molar ratio of repeating units of other than formula I in the copolymer to repeating units of formula I, is particularly preferably no more than 4 to 1. The ethylenically unsaturated comonomer which is used to copolymerize with the UV absorbing monomer of formula (I), can be selected to impart desired physical and/or chemical properties to the copolymer to be prepared, for examples, glass transition temperature, particle size, compatibility with a binder such as gelatin or other photographic additives, for example, anti-oxidants and known color image forming agents, etc.

Examples of the polymeric UV absorbing agents are listed below (the number inside the parenthesis represents the molar ratio):

| Polymer Identification | Composition |
|---|---|
| P-1 | M-1:M-2: Methyl methacrylate (0.6:0.4:1) |
| P-2 | M-1:M-2: t-Butyl Acrylamide (0.6:0.4:1) |
| P-3 | M-1:M-2: Styrene (0.6:0.4:1) |
| P-4 | M-1:M-2 (0.6:0.4) |
| P-5 | M-3 Homopolymer |
| P-6 | M-3: Butyl Acrylate (1:2) |
| P-7 | M-6 Homopolymer |

Any of a large variety of high boiling point organic solvents (including mixtures thereof), having a boiling point of at least 200° C. may be used in the present invention. Such solvents are typically used as coupler solvents or for various other photographic applications, and are described, for example, U.S. Pat. No. 4,840,878, U.S. Pat. No. 4,745,049, German Patent DD 225,240 A1, U.S. Pat. No. 3,764,336, U.S. Pat. Nos. 4,857,449, 4,250,251, U.S. Pat. No. 4,419,439, U.S. Pat. No. 4,557,999, U.S. Pat. No. 2,322,027, U.S. Pat. No. 2,759,821, U.S. Pat. No. 4,203,767, Japanese patent application 54/4125, and Research Disclosure 207, p. 268(1981). High boiling point solvents are usually esters or amides from the derivatives of phthalic acid, phosphoric acid, oleic acid, adipic acid, azelaic acid, benzoic acid, citric acid, ricinoleic acid, sebacic acid, stearic acid, sulfonic acid , and trimellitic acid, or derivatives of epoxy, glycol, hydrocarbons, polyesters, and terpenes. High boiling point solvents may particularly include phosphates, phthalates, amides, esters, anilides, alcohols or sulfoxides. Particular organic solvents with a boiling point of at least 200° C. include tricresyl phosphate, di-n-butyl phthalate, N-n-amylphthalimide, bis(2-methoxyethyl)phthalate, dimethyl phthalate, ethyl N,N-di-n-butyl-carbamate, diethyl phthalate, n-butyl 2-methoxybenzoate, 2-(n-butoxyethyl) phthalate, ethyl benzylmalonate, n-amyl phthalate, n-hexyl benzoate, guaiacol acetate, tri-m-cresyl phosphate, diethyl sebacate, di-isoamyl phthalate, ethyl phenylacetate, phorone, di-n-butyl sebacate, dimethyl sebacate, N,N-diethyl lauramide, N,N-di-n-butyl lauramide, phenethyl benzoate, benzyl benzoate, dioctyl phthalate, dioctyl sebacate, quinitol bis(2-ethylhexoate), cresyl diphenyl phosphate, butyl cyclohexyl phthalate, tetrahydrofurfuryl adipate, tetrahydrofurfuryl benzoate, tetrahydrofurfuryl propionate, tetrahydrofurfuryl palmirate, quaiacol n-caproate, bis(tetrahydrofurfuryl)phthalate, N,N-diethylcapramide, 2,4-di-tert-amylphenol, 1-lauryl piperidine, N-n-butylacetanilide, N,N,N',N'-tetraethyl phthalamide, N,n-amylsuccinimide, diethyl citrate, 2,4-di-n-amylphenol, 1,4-cyclohexyllemedimethylene bis(2-ethylhexanoate), benzylbutyl phthalate, p-dodecylphenol, trihexylphosphate, isopropyl palamitate, and bis(2-ethylhexyl)sulfoxide, and the like.

Preferred examples of high boiling point organic solvents for the present invention are:

| Solvent I.D. | Chemical Name |
|---|---|
| C-1 | Tritolyl Phosphate |
| C-2 | Dibutyl phthalate |
| C-3 | N,N-Diethyldodecanamide |
| C-4 | Phenethyl Benzoate |
| C-5 | 2,4-Di-t-Pentylphenol |
| C-6 | N-n-Butylacetanilide |
| C-7 | 1,4-Cyclohexanedimethanol bis(2-ethylhexanoate) |
| C-8 | Benzylbutylphthalate |
| C-9 | p-Dodecylphenol |
| C-10 | Trihexylphosphate |
| C-11 | Isopropyl palmitate |
| C-12 | Bis(2-ethylhexyl)sulfoxide |
| C-13 | Tri-2-ethylhexylphosphate |
| C-14 | Diphenyl phthalate |
| C-15 | Trioctylphosphine oxide |
| C-16 | 1-Undecanol |
| C-17 | Oleyl Alcohol |
| C-18 | Hexadecane |
| C-19 | N-2-Ethylhexyl-p-toluene-sulfonamide |
| C-20 | Dihexyl hexylphosphonate |
| C-21 | Didecyl phthalate |
| C-22 | 2-Ethylhexyl-p-hydroxybenzoate |
| C-23 | Tributyl citrate |
| C-24 | Bis(2-ethylhexyl)azelate |
| C-25 | Acetyl tributyl citrate |
| C-26 | Trioctylamine |
| C-27 | Dodecylbenzene |
| C-28 | 3-Phenoxytoluene |

The polymer latexes are preferably prepared by emulsion polymerization, as already described. Emulsion polymerization is well known in the art and is described in F. A. Bovey, *Emulsion Polymerization,* issued by Interscience Publishers Inc. New York, 1955. Examples of the chemical initiators which may be used include a thermally decomposable initiator, for example, a persulfate (such as ammonium persulfate, potassium persulfate, etc), hydrogen peroxide, 4,4'-azobis (4-cyanovaleric acid), and redox initiators such as hydrogen peroxide-iron(II) salt, potassium persulfate-sodiumhydrogensulfate, cerium salt-alcohol, etc. Emulsifiers which may be used in the emulsion polymerization include soap, a sulfonate (for example, sodium N-methyl-N-oleoyltaurate, etc.), a sulfate (for example, sodium dodecyl sulfate, etc.), a cationic compound (for example, hexadecyl trimethylammonium bromide, etc.), an amphoteric compound and a high molecular weight protective colloid (for example, polyvinyl alcohol, polyacrylic acid, gelatin, etc.). Specific examples and fuctions of the emulsifiers are described in *Belgische Chemische Industrie,* Vol. 28, pages 16–20(1963).

Emulsion polymerization of solid water-insoluble UV absorbing monomer is usually carried out in an aqueous system or a water/organic solvent system. Organic solvents which can be used are preferably those which have high water miscibility, are substantially inert to the monomers to be used, and do not interrupt usual reactions in free radical addition polymerization. Preferred examples include a lower alcohol having from 1 to 4 carbon atoms (for example, methanol, ethanol, isopropanol, etc.), a ketone (for example, acetone, etc.), a cyclic ether (for example, tetrahydrofuran, etc.), a nitrile (for example, acetonitrile,etc.), an amide (for example, N,N-dimethylforamide, etc.), a sulfoxide (for example, dimethylsulfoxide), and the like. This method is the most direct way of preparing a polymer latex as described in U.S. Pat. Nos. 4,464,462; 4,455,368 and European Patent publication 0 190 003 (1991).

As to the method of loading the high boiling point organic solvent in the polymer latex, "loading" a polymer latex is generally described in U.S. Pat. No. 4,199,363 for example. There are several methods of loading the high boiling point solvents into the polymer latex. First, an aqueous dispersion of a high boiling point solvent (or mixture of such solvents) is prepared by the conventional colloid mill process in the presence of gelatin. This dispersion is then blended with the polymer latex such that the weight ratio of high boiling, water immiscible organic solvent to polymer latex is between 0.1 to 5.0 (that is, 0.1/1 to 5.0/1 of solvent-/polymer latex), and more preferably between 0.2 to 3.0 (that is, 0.2/1 to 3.0/1 of solvent/polymer latex).

In a second method of loading the polymer latex, the high boiling point solvent is loaded into the polymeric UV absorbing agent in the presence of low boiling organic solvents, such as methanol or acetone. The auxilliary solvent is then evaporated with a rotarary evaporator. The same weight ratios of high boiling, water immiscible organic solvent can be used as in the above method.

Loading of a polymer latex is described, for example, in U.S. Pat. No. 4,203,716, U.S. Pat. No. 4,214,047, U.S. Pat. No. 4,247,627, U.S. Pat. No. 4,497,929 and U.S. Pat. No. 4,608,424.

Conventional UV absorbing agents can also be loaded into the UV absorbing polymer latexes of the photographic elements of the present invention to alter their photographic performance. Examples of such conventional UV absorbing agents which can be used include: 2-(2-hydroxy-5-methylphenyl)-2H-benzotriazole, 2-(2-hydroxy-3,5-di-tert-butylphenyl)-2H-benzotriazole, 2-(2-hydroxy-3-tert-butyl-5-methylphenyl)-2H-benzotriazole, 2-(2-hydroxy-3,5-di-tert-butylphenyl)-5-chloro-2H-benzotriazole, 2-(2-hydroxy-3,5-di-tert-amylphenyl)-2H-benzotriazole, 2-(2-hydroxy-3,5-di(1,1-dimethylbenzyl)-phenyl)-2H-benzotriazole, 2-(2-hydroxy-5-tert-octylphenyl)-2H-benzotriazole, Other types of UV absorbing agents such as p-hydroxybenzoates, phenylesters of benzoic acid, salicylanilides and oxanilides, diketones, benzylidene malonate, esters of 1-cyano-b-phenylcinnamic acid, and organic metal photostabilizers, and others, as described in J. F. Rabek, *Photostabilization of Polymers, Principles and Applications,* Elsevier Science Publishers LTD, England, page 202–278(1990).

The loaded polymer dispersion is incorporated into the photographic element (typically into a gelatin gel thereof) in an amount of between 0.2 $g/m^2$ to 10 $g/m^2$, and more preferably between 0.5 $g/m^2$ to 5.0 $g/m^2$. Furthermore, the weight ratio of high boiling, water immiscible organic solvent to polymer latex is preferably between 0.1 to 5.0 (that is, 0.1/1 to 5.0/1 of solvent-/polymer latex), and more preferably between 0.2 to 3.0 (that is, 0.2/1 to 3.0/1 of solvent/polymer latex).

The polymer latex is added to any one or more of the layers (for example, a hydrophilic colloid layer) of a photographic light-sensitive material (for example, a silver halide photographic light-sensitive material), such as a surface protective layer, an intermediate layer or a silver halide emulsion layer, and the like. For example, in photographic paper the UV absorbing polymer latex may be positioned above and/or below the red sensitive layer (typically adjacent to it), the red sensitive layer typically being the uppermost light sensitive layer in color paper, or even completely or partially within the red sensitive layer.

The photographic elements made by the method of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, with the reverse order on a reflective support being typical.

In the following discussion of suitable materials for use in elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

With negative working silver halide a negative image can be formed. Optionally a positive (or reversal) image can be formed although a negative image is typically first formed.

The photographic elements of the present may also use colored couplers (e.g. to adjust levels of interlayer correction) and masking couplers such as those described in EP 213.490; Japanese Published Application 58-172,647; U.S. Pat. No. 2,983,608; German Application DE 2,706,t17C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188 ); electron transfer agents (U.S. Pat. No. 4,859,578; U.S. Pat. No. 4,912,025 ); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323. ) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's ). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662 ; GB 2,032,914; GB 2,099,167; DE 2,842,063, DE 2,937,127 ; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-! 077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements of the present invention may be silver iodobromide, silver bromide, silver chloride, silver chlorobromide, silver chloroiodobromide, and the like. The type of silver halide grains preferably include polymorphic, cubic, and octahedral. The grain size of the silver halide may have any distribution known to be useful in photographic compositions, and may be ether polydipersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred to that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure,* Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process.* These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, DH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure,* June 1975, item 13452 and U.S. Pat. No. 3,772,031.

The silver halide may be sensitized by sensitizing dyes by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVIII. This typically involves exposure to light in the visible region of the spectrum.

Photographic elements comprising the composition of the invention can be processed in any of a number of well-known photographic processes utilizing any of a number of well-known processing compositions, described, for example, in *Research Disclosure I,* or in James, *The Theory of the Photographic Process* 4th, 1977. In the case of processing a reversal color element, the element is first treated with a black and white developer followed by treatment with a color developer. Preferred color developing agents are p-phenylenediamines. Especially preferred are:

4-amino N,N-diethylaniline hydrochloride,
4-amino-3-methyl-N,N-diethylaniline hydrochloride,
4-amino-3-methyl-N-ethyl-N-(β-(methanesulfonamido) ethylaniline sesquisulfate hydrate,
4-amino-3-methyl-N-ethyl-N-(β-hydroxyethyl)aniline sulfate,
4-amino-3-β-(methanesulfonamido)ethyl-N,N-diethylaniline hydrochloride and
4-amino-N-ethyl-N-(2-methoxyethyl)-m-toluidine di-p-toluene sulfonic acid.

Development is followed by bleach-fixing, to remove silver or silver halide, washing and drying.

The present invention will be further described in the following Examples.

EXAMPLES

Synthesis of Polymers

Synthesis of P-1 is described below as typical example. 412 g of deionized water, 1.092 g of sodium N-methyl-N-oleoyltaurate (Igepon T-77), and 41 g of acetone were mixed in a IL 4-neck round bottom flask equipped with a mechanical stirrer, nitrogen inlet, and condenser. The flask was immersed in a constant temperature bath at 80° C. and heated for 30 mins with nitrogen purging through. 0.3 g of methyl methacrylate and 0.5 g of 5% ammonium persulfate was added and polymerized for one hour. 0.4 g of ammonium persulfate in 5 ml of water was further added. Monomer solution comprising 6.18 g of M-1, 4.12 g of M-2, 2.7 g of methyl methacrylate and 206 mL of N,N-dimethylforamide was then pumped into the reactor over three hours. The polymerization was continued for 8 hours. The latex was cooled, filtered and dialyzed against distilled water overnight and concentrated to 7.16% solid with Amicon's Ultrafiltration unit. The Z-average particle size measured by Malvern's Autosizer IIC was 58 nm. Tg was 108° C. The elemental analysis confirmed the composition.

The physical properties of polymers P-2 to P-7 are described in Table 1.

TABLE 1

| Polymer | Average Latex Particle Size (nm) | % Solid |
|---|---|---|
| P-2 | 106 | 4.61 |
| P-3 | 62 | 7.62 |
| P-4 | 54.6 | 4.01 |
| P-5 | 38 | 5.31 |
| P-6 | 41 | 8.14 |
| P-7 | 93 | 5.2 |

An alternative method of preparation of the M-3 polymer, in which no organic co-solvent was used, is as follows. In this method, M-3 was fed into the reactor as a solid dispersion instead of a solution. The solid dispersion was prepared as follows. 48.5 g of M-3, 2.585g of 2-acrylamido-2-methyl-1-propanesulfonic acid (58% in sodium salt form), 3.82 g of sodium dodecylbenzene sulfonate, 0.42 g of sodium bicarbonate and 200 g of distilled water were mixed and homogenized with a tissue homogenizer for 10 minutes. The solid dispersion was charged to a 500 ml 3-neck flask equipped with a $N_2$ inlet, mechanical stirrer and condenser. The flask ws immersed in a constant temperature bath at 80° C. and heated for 30 mins with $N_2$ purging through the flask. 15 ml of 5% potassium persulfate was added to initiate the polymerization. 5 ml of 5% potassium persulfate was further added after three hours. Total polymerization time was 20 hours. The resulting latex was cooled and filtered through a 400 mesh sieve. The final particle size was 54.6 nm and the % solid was 22.9%.

Photographic Evaluation

The light stability of the UV absorbing agents themselves is very important for the protection of photographic materials from dye fade and formation of light induced stain due to unreacted couplers. To evaluate the light stability of the UV absorbing polymer latexes of Table 1, loaded with high boiling point solvent, the following coating format for the polymeric UV absorbing latexes with and without the solvents, was used:

| | |
|---|---|
| Gel | 100 mg/ft$^2$ |
| BVSME | 1.75 mg/ft$^2$ |
| UV Absorbing Agent | 0.17 mmole/ft$^2$ |
| ± Coupler Solvents | (0.5:1 wt ratio if used) |
| Cellulose Triacetate Film Support | |

*BVSME — Bis(vinylsulfonyl methyl) Ether

Solvents are added to the polymeric UV absorbing agents by the following method. The dispersion of solvents are prepared by the conventional colloid mill process in the presence of gelatin. The solvent dispersion obtained was then mixed with polymeric UV absorbing agents and stirred for one hour. The weight ratio of the solvent to the polymeric UV absorbing agent is 0.5:1.

The light stability of these coatings were tested using the typical Xenon fadeometer exposure with Xe arc lamp as light source at 25° C. for various lengths of time. The samples were irradiated at a distance such that the irradiance on the sample was 50 Klux. The UV absorption spectrum of each sample was taken both before and after irradiation, and the % loss of the absorbance at 360 nm was used as in index of light stability. The results are shown in Table 2.

TABLE 2

| Polymer | High Boiling Point Solvent | Irradiation Time(weeks) | % Loss | Remarks |
|---|---|---|---|---|
| P-1 | None | 4 weeks | 47.01 | Comparison |
| | C-1 | same | 3.76 | Invention |
| | C-2 | same | 5.24 | Invention |
| P-1 | None | 2 weeks | 25.83 | Comparison |
| | C-1 | same | 3.26 | Invention |
| | C-5 | same | 3.8 | Invention |
| | C-3 | same | 3.96 | Invention |
| | C-8 | same | 4.75 | Invention |
| | C-10 | same | 4.81 | Invention |
| | C-12 | same | 5.38 | Invention |
| | C-2 | same | 5.4 | Invention |
| P-2 | None | 4 weeks | 45.36 | Comparison |
| | C-1 | same | 1.06 | Invention |
| | C-2 | same | 6.6 | Invention |
| | C-9 | same | 5.71 | Invention |
| P-2 | None | 2 Weeks | 32.64 | Comparison |
| | C-1 | same | 3.01 | Invention |
| | C-2 | same | 4.34 | Invention |
| | C-12 | same | 4.39 | Invention |
| | C-6 | same | 6.33 | Invention |
| | C-8 | same | 6.66 | Invention |
| | C-3 | same | 7.15 | Invention |
| | C-4 | same | 7.65 | Invention |
| P-3 | None | 4 weeks | 26.23 | Comparison |
| | C-1 | same | 4.28 | Invention |
| | None | 2 weeks | 9.84 | Comparison |
| | C-1 | same | 1.52 | Invention |
| P-4 | None | 4 weeks | 39.11 | Comparison |
| | C-1 | same | 18.79 | Invention |
| | None | 2 weeks | 15.56 | Comparison |
| | C-1 | same | 6.91 | Invention |
| P-5 | None | 6 weeks | 42.91 | Comparison |
| | C-1 | same | 21.03 | Invention |
| | None | 4 weeks | 25.3 | Comparison |
| | C-1 | same | 9.65 | Invention |
| | None | 2 weeks | 8.36 | Comparison |
| | C-1 | same | 0 | Invention |
| P-6 | None | 2 weeks | 5.49 | Comparison |
| | C-1 | same | 0.29 | Invention |
| P-7 | None | 2 weeks | 74.7 | Comparison |
| | C-1 | 2 weeks | 46.8 | Invention |
| | None | 1 week | 40.8 | Comparison |
| | C-1 | 1 week | 22 | Invention |

It will be seen from Table 2 above, that UV absorbing polymer latexes loaded with high boiling point organic solvents (the invention) showed increased light stability (that is, lower "% loss") over the absorbing polymer latex not loaded with the high boiling point organic solvent. That is, light stability of the UV absorbing polymeric latexes is greatly improved by loading with high boiling point organic solvents.

The preceding examples are set forth to illustrate specific embodiments of this invention and are not intended to limit the scope of the compositions or materials of the invention. It will be understood that variations and modifications can be effected within the spirit and scope of the invention.

What is claimed is:

1. A method of preparing a photographic element containing a UV filter composition, the method comprising preparing a UV absorbing polymer latex by emulsion polymerization, then loading the polymer with a water immiscible high boiling point organic solvent having a boiling point at atmospheric pressure of at least 200° C., and incorporating the loaded polymer latex into a photographic element.

2. A method according to claim 1 wherein the UV absorbing polymer latex is obtained by emulsion polymerization of monomers which includes monomers of the formula:

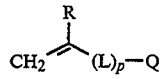

(I)

wherein:

R represents a hydrogen atom or an alkyl group;

L represents a bivalent linking group;

p is 0 or 1; and

Q is of the formula:

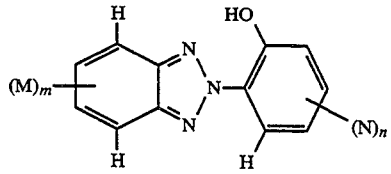

(II)

wherein:

m is 0 to 2;

n is 0 to 3, provided n or m is at least 1, and the phenyl and benzo rings may be optionally further substituted except at the positions at which -H is shown; and M and N represent locations at which Q is bonded to the remainder of the monomer of formula I.

3. A method according to claim 1 wherein the UV absorbing polymer latex is obtained by emulsion polymerization of monomers which includes monomers of the formula:

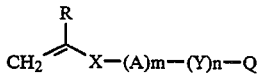

wherein:

R represents a hydrogen atom or an alkyl group having from 1 to 4 carbon atoms or a chlorine atom;

X represents —CONH—, —COO— or a phenylene group;

A represents a linking group selected from an alkylene group having from 1 to 20 carbon atoms or an arylene group having from 6 to 20 carbon atoms;

Y represents —COO—, —OCO—, —CONH—, —NHCO—, —NHCONH—, —OCONH—, —$SO_2$NH—, —NH$SO_2$—, —$SO_2$—, or —O—;

m represents 0 or 1 and n represents 0 or 1; and

Q represents an UV absorbing group of the following formula:

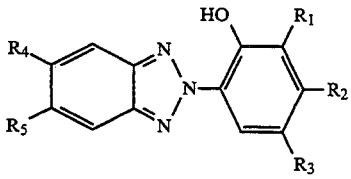

wherein:

$R_1$,$R_2$,$R_3$,$R_4$, and $R_5$ independently represent hydrogen, halogen, an alkyl group having from 1 to 20 carbon atoms, an aryl group having from 6 to 20 atom carbon atoms, an alkoxy group having from 1 to 20 carbon atoms, an aryloxy group having from 6 to 20 carbon atoms, an alkylthio group having from 6 to 20 carbon atoms, an amino group, an aminoalkyl group having from 1 to 20 carbon atoms, an arylamino group having from 6 to 20 carbon atoms, a hydroxy, a cyano, a nitro, an acylamino group, a carbamoyl group, a sulfonyl group, a sulfamoyl group, a sulfonamido group, an acyloxy group, provided that at least one of $R_1$,$R_2$,$R_3$,$R_4$, and $R_5$ is a divalent group which bonds to the remainder of the monomer of formula I.

4. A method according to claim 3 wherein the monomers of formula I have the formula IIIA or IIIB below:

IIIA

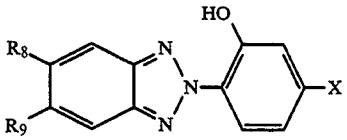

IIIB

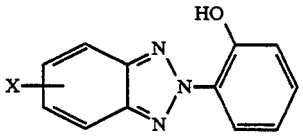

wherein:

X is one of the following groups:

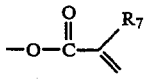

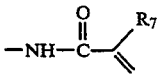

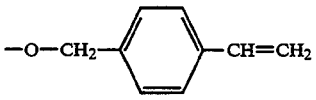

-continued

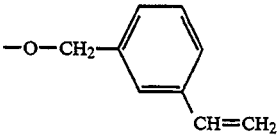

$R_7$ is 1 to 4 carbon atom alkyl group and all of the rings have no further substituents than those shown.

5. A method according to claim 2 wherein the high boiling point organic solvent is a phosphate, phthalate, amide, ester, anilide, alcohol or sulfoxide.

6. A method according to claim 2 wherein the loaded polymer dispersion is incorporated into the photographic element in an amount of between 0.2 g/m$^2$ and 10 g/m$^2$.

7. A method according to claim 2 wherein the weight ratio of the water immiscible high boiling organic solvent to polymer latex is between 0.1 to 5.0.

8. A method according to claim 2 wherein the polymer is loaded with the high boiling point organic solvent by mixing the polymer latex with aqueous dispersion of an immiscible solvent, which immiscible solvent is at least partly the high boiling point organic solvent.

9. A method according to claim 2 wherein the loaded polymer latex is incorporated into a gelatin gel of a photographic element.

10. A method according to claim 2 wherein the polymer is a copolymer additionally having repeating units of either the formula:

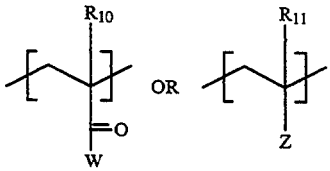

wherein

W is substituted or unsubstituted amino, substituted or unsubstituted alkoxy, substituted or unsubstituted phenoxy; Z is a substituted or unsubstituted phenyl; and $R_{10}$ and $R_{11}$ are H or a substituted or unsubstituted 1 to 6 carbon atom alkyl.

11. A method according to claim 2 wherein the polymer is a copolymer and the molar ratio of repeating units other than formula I to repeating units of formula I, is no more than 4 to 1.

* * * * *

UNITED STATES PATENT AND TRADEMARK OFFICE

CERTIFICATE OF CORRECTION

PATENT NO. : 5,372,922

DATED : December 13, 1994

INVENTOR(S) : Edward Schofield et al.

It is certified that error appears in the above-indentified patent and that said Letters Patent is hereby corrected as shown below:

ON THE TITLE PAGE ITEM [54] AND COL. 1, LINE 4, READING:

"ULTRAV33ET10BSORBERS" should read -- ULTRAVIOLET

Signed and Sealed this

Twenty-fifth Day of April, 1995

*Attest:*

Bruce Lehman

BRUCE LEHMAN

*Attesting Officer*

*Commissioner of Patents and Trademarks*